United States Patent [19]

Kistner

[11] 3,995,849

[45] Dec. 7, 1976

[54] SHEET FOLDING MACHINE WITH ROLLERS AND A POCKET

[76] Inventor: Hermann Kistner, Panoramaweg 4, 7141 Neckarweihingen, Germany

[22] Filed: June 26, 1975

[21] Appl. No.: 590,728

Related U.S. Application Data

[63] Continuation of Ser. No. 64,348, Aug. 17, 1970, abandoned.

[52] U.S. Cl. ..... 270/68 A
[51] Int. Cl.[2] ..... B65H 45/14
[58] Field of Search ..... 270/68 A, 68 R

[56] References Cited

UNITED STATES PATENTS

| | | | |
|---|---|---|---|
| 1,390,213 | 9/1921 | Olson | 270/68 A |
| 1,525,969 | 2/1925 | Waterworth | 270/68 A |
| 2,414,386 | 1/1947 | Olson | 270/68 A |

FOREIGN PATENTS OR APPLICATIONS

| | | | |
|---|---|---|---|
| 1,240,095 | 5/1967 | Germany | 270/68 A |
| 555,375 | 5/1930 | Germany | 270/68 |
| 332,150 | 7/1930 | United Kingdom | 270/68 |

OTHER PUBLICATIONS

"Deutscher Drucker," 11-69; Maschinenbau Oppenweller Binder Co., (author).

"Entre Nous," p. 13, distributed by Leysen & Meier S. A.; Maschinenbau Oppenweller Binder Co., - MBO, (author).

*Primary Examiner*—Edgar S. Burr
*Assistant Examiner*—A. Heinz
*Attorney, Agent, or Firm*—Thomas J. Greer, Jr.

[57] ABSTRACT

In a sheet folding machine of the type having three elongated rollers and a pocket, said pocket having a pair of elongated lip members extending parallel to the axes of said rollers and into a space provided between two of said rollers, said lip members forming between them an elongated opening for guiding between them a sheet, such as a paper sheet or a carton, to be folded into the pocket, elements defining opposite walls of said pocket, one of the wall elements having a portion adjoining the opening of the pocket and secured to one of the lip members adjustably in a direction transversely to the opening and extending into close proximity to an entrance surface of the respective lip member, whereby the width of said opening is adjustable to different sheet thicknesses without changing the position of the lips relative to each other and to said rollers.

11 Claims, 6 Drawing Figures

INVENTOR:

BY:

INVENTOR:

BY:

INVENTOR:

BY:

INVENTOR:

BY:

SHEET FOLDING MACHINE WITH ROLLERS AND A POCKET

This is a Continuation, of application Ser. No. 64,348, filed Aug. 17, 1970 now abandoned.

BACKGROUND OF INVENTION

The invention relates to the well-known types of folding machines which are disclosed for instance in the U.S. Pat. Nos. 2,847,209 of Olson and 3,328,026 of Bartizal, Jr., in West German Patent 962,258, in East-German Patent 37,058, in the magazine "Deutscher Drucker" of Nov. 27, 1969, FIG. 22 and the appertaining text in the right hand column on the same page, as well as on page 13 of a pamphlet "entre nous" distributed by the French company Leysen & Meier S.A..

The prior-known shape of the upper and lower lips of the folding or buckling pockets as well as the space between the guide rods forming the walls of the pockets determine the accuracy of the folding. The folding accuracy is increased by guiding the paper as closely as possible between the lips and the adjoining wall portions of the pockets.

In West-German Patent 962,258 it is recommended to bring the three folding rollers cooperating with the folding pocket as closely together as possible, which requires, however, the control of the lower lip of the folding pocket. This is not only more expensive but also prevents a high rate of folding sequences.

East-German Patent 37,058 discloses a folding pocket which provides a varying adjustable spacing between the upper and lower rods forming the walls of the pocket so as to render the folding pocket adjustable for varying paper thicknesses or for single and multiple pre-folded paper layers. This pocket has a rearward portion only adjustable but the front portion of the pocket is not variable so that the adaption is ineffective for short papers to be folded. Besides, the transition region between the forward upper pocket inlet to the adjoining sheet guide is not suited to permit pre-folded sheets having a short upwardly projecting flap, acting like a grapple hook, to leave the pocket. Thus, this type of folding machine is excluded from use for this frequently occuring pamphlet folding. Moreover, the transverse waving is increased by this construction in that the forward unadjustable lips have always to be adjusted at maximum width so as to accomodate all paper thicknesses. A further very aggravating disadvantage for high-speed machines is that the upper lip has surfaces paralleling the path of the sheet, on which the fast moving sheet sliding over it may be statically charged, whereupon the magnetism produced thereby impedes the entry of the sheet, which leads to a premature or inaccurate fold.

Other known machines have the pocket formed into an upper and lower frame portion each carrying a lip and being spring biased against each other and being adjustable within certain limits by pressure screws so as also to receive heavier paper layers. Here the lips are for adjustment moved away from each other so that they have to have sufficient spacing from the folding rollers, a distance which has, however, to be kept small for bent sheets because these have the tendency to enter into any space that offers itself in bypassing the folding pocket opening. This leads to malfunctioning and stoppage.

Finally, arrangements based on machines built by the inventor himself have been sketchily published before the filing of the present application. However, these publications either do not disclose the essential features of the invention, or the authors of those publications — the above named magazine "Deutscher Drucker" and the pamphlet "entre nous" misunderstood or did not actually know the construction or for other reasons mis-represented it so as not to teach the actual invention as it is disclosed and claimed in the present application.

THE OBJECTS OF THE INVENTION

The main object of the invention is the provision of a folding pocket overcoming the aforesaid and other shortcomings of prior known constructions.

A more specific object of the invention is the provision of a folding pocket being adjustable over its entire length or depth for the reception of sheets of varying thicknesses or of pre-folded sheets without changing the position of the lips from their fixed, as close as possible arrangement relative to the rollers.

Further objects of the invention will become apparent from the following description of the invention, from the description of a preferred embodiment of the invention, from the illustration of such embodiment in the attached drawings, and from the attached claims.

THE INVENTION

The adjustable elements determining the inner width of the folding pockets extend, according to the present invention, close to the front side of the funnel-shaped elongated opening formed by the lips, the lips having a spacing from each other, which is about as great or greater than the maximum opening width required for the thickest sheet or pile of sheets to be handled by the machine.

The line of separation, at which the adjustable pockets rods adjoin the stationary upper lip is arranged, in accordance with the present invention, at a place which can impede the neither ordinary sheets nor sheets having a prefolded short flap from leaving the pocket. Upon increase of the inner width, done in a simple manner by adjusting the position of a supporting angle for the upper pocket rods attached to the upper lip member, the pocket opens up in its forward regions without restriction and without displacement of the lip. A rearward supporting angle for the rods forming the pocket walls is, in a manner known per se, adjustable by screws acting against a bias of a pressure spring, so as to obtain a pocket having parallel walls and having throughout the same width. This feature may be dispensed with, if, on account of the folding length the sheet would in most cases fill but a small part of the length of the pocket.

The invention provides a pocket which in its entirety, also in its forward part, participates in the adaptation of its width and in which particularly thin sheets are guided at once after the deflection closely and inescapably by the pocket walls.

Moreover, the invention simultaneously avoids a surface paralleling the direction of the path of the sheet, on which electrically charged papers are magnetically held, since already in the entry zone and before the deflection of the sheet the guiding of the sheets is taken over by the adjustable pocket rods, which have ridges extending in the direction of movement of and thus merely have line contact with the sheet.

Because the buckling of the sheet, following the sheet's engagement of an abutment or stop in the pocket, causes the sheet to use any freedom of movement for forming transverse waves or creases, a close guiding of the sheet right from the beginning, as achieved by the invention, is important so as to obtain exact uniform placing of the fold.

The upper lip member is, according to the present invention, merely a rail or rod having a surface slightly inclined with respect to the entering sheet, which will securely deflect and guide even wavy sheet margins into the pocket without ever forming a surface paralleling the direction of the path of the sheet. This lip member is part of a strong profile offering room for the reception of the bent front ends of the pocket rods even when these are highly adjusted for the largest or smallest pocket opening; the profile offers a surface for screwing or bolting on a height-adjustable supporting angle, to which the pocket rods are fastened.

This upper lip member may, just like the lower fixedly secured lip member, be arranged very close to the folding rollers whereby a decrease of the folding space is achieved, which, as described above, is advantageous for the formation of the fold.

The folding pocket formed in accordance with the invention may be adjusted quickly for the thinnest and the thickest sheet thicknesses and avoids the disadvantages and shortcomings of the known constructions.

The proneness to folding or buckling of thicker sheets or of prefolded sheet layers is increased in the machine designed in accordance with the invention on account of the lip members being arranged closer to the rollers thereby permitting buckle-folding which, on account of the thickness of the material, was not possible with the known pocket constructions. A wide field of folding possibilities is thereby removed from the realm of the slow and cycle-bound knife-edge folding and transferred into the realm of the fast cycle-free buckle folding.

THE DRAWINGS

A preferred embodiment of the invention is illustrated in the attached drawings in which.

DESCRIPTION OF THE EMBODIMENT SHOWN IN THE DRAWING

Figure 1:
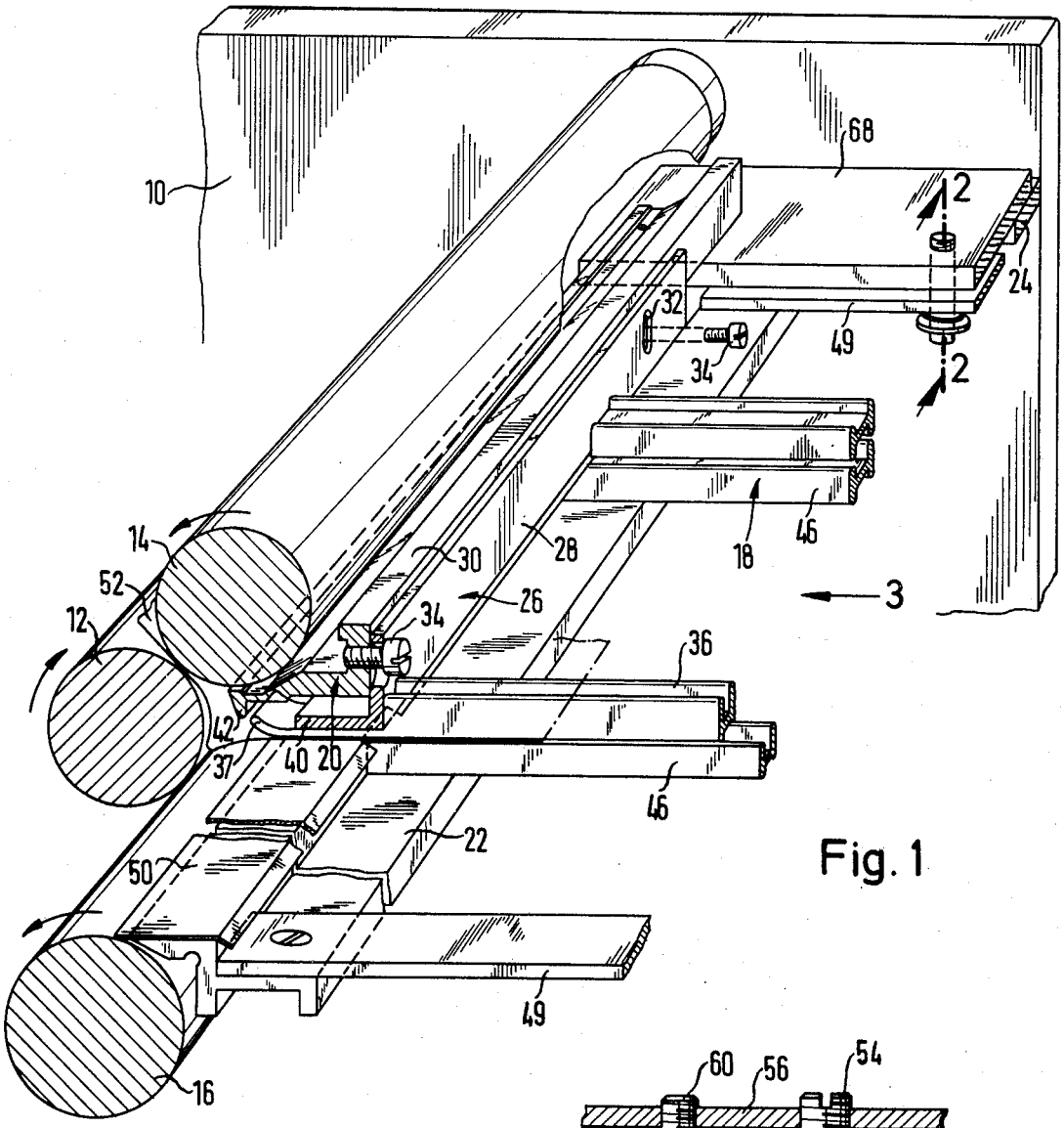
FIG. 1 is a fragmentary perspective view, partly in section, of folding rollers and of a folding pocket showing the essential features of the invention.
Figure 2:
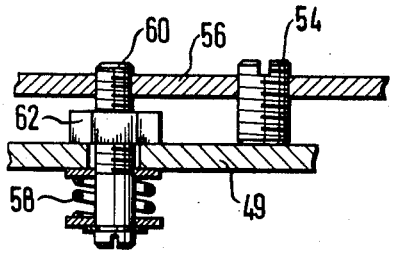
FIG. 2 is a fragmentary section on a larger scale along line 2—2 of FIG. 1 through the means for adjusting the width of the inner portions of the pocket.
Figure 3:
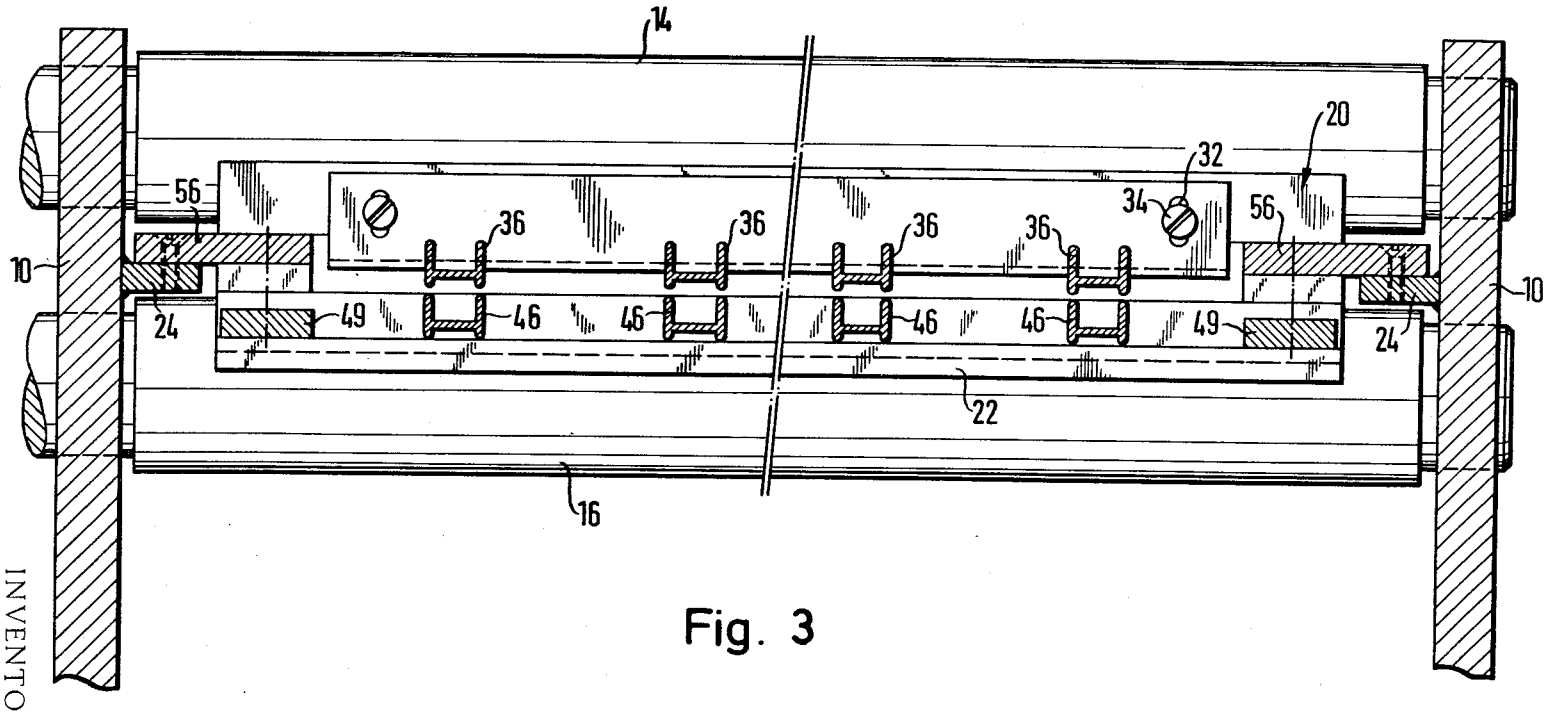
FIG. 3 is a fragmentary view of the rollers and, partly in section, of the pocket viewed in the direction of arrow 3 in FIG. 1.
Figure 4:
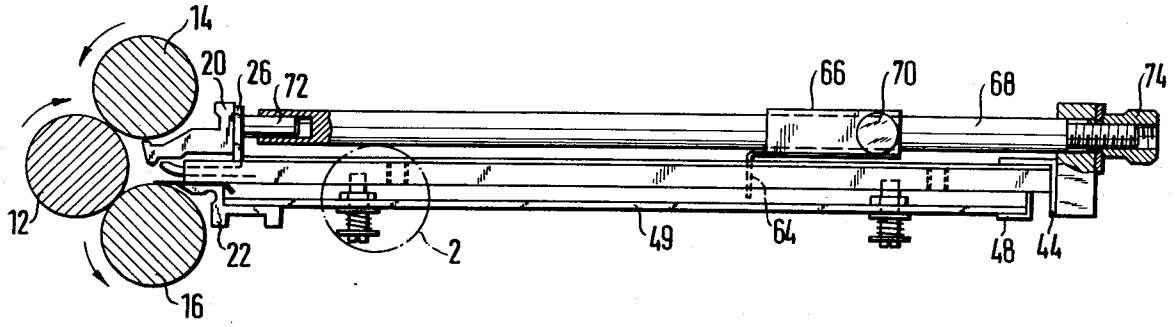
FIG. 4 is a side elevation and a partial section of the elements shown in FIG. 1 on a smaller scale, disclosing more in detail the means for adjusting the width of the inner reaches of the pocket, the abutment determining the depth of the pocket, and the means for adjusting said abutment.

In a machine frame represented by side plates 10 three rollers are rotatably mounted, a first or middle roller 12, a second or upper roller 14 and a third or lower roller 16. The middle axes of the rollers are, seen in section transversely to these axes, arranged on the apexes of a triangle. The first roller 12 is in contact with the second roller 14 as well as with the third roller 16. The rollers are driven in unison in a manner well-known in the art so that it is deemed superfluous to illustrate and describe the means for imparting such rotation. Furthermore the rollers may be adjustable so that there is the desired amount of pressure of their mutually engaging cylindrical surfaces. Again this may be done by means well known in the art, which do not form part of the present invention and which therefore are neither illustrated nor described.

There is an open space between the second roller 14 and the lower roller 16. Into this space extends the forward portion of a folding pocket generally designated by the numeral 18. This pocket 18 comprises an upper lip member 20 and a lower lip member 22. Both these lip members are secured at each end to a bracket 24 integrally attached to the side plates 10.

A L-section rail 26 rests by one vertical arm 28 against the upstanding arm 30 of upper lip member 20, is provided with vertically elongated slots 32 through which screws 34 extend, the screws being screwed into screw-threaded holes on arm 30 of lip member 20. On account of this connection by elongated slots 32 and screws 34, the member 26 may be adjusted in its height relative to lip member 20 and hence relative to the side plates 10 of the frame and relative to the rollers 12, 14, 16.

Rods 36 are near their forward ends 37 secured, such as by screws 38, to the horizontal arm 40 of L-section rail 26. These U-section rods 36 have their forward ends 37 offset or notched so as to receive the L-section rail 26, and the ends 37 are upwardly bent off so as to extend into a space behind a downwardly extending ridge 42 provided on upper lip member 20. The rear ends of rods 36 are secured to another L-section rail 44 which in turn has its lateral ends fastened to the side plates 10.

Lower lip member 22 is recessed along its rear side for the reception of a second set of rails or rods 46 which again have their rear ends supported by L-section rail 48. Rail 48 has its lateral ends connected to a pair of rails 49, the latter having their front ends secured to the lower lip member 22 and paralleling the rods 46.

Lower lip member 22 carries on its upper side a plate 50 extending over the upper surface of lower roller 16 so that a sheet 52 drawn in between middle roller 12 and upper roller 14 will hit this plate 50 and be guided by it into the interior of the pocket after the sheet first having engaged the forward surface of lip member 20 and its ridge 42.

Figure 5:
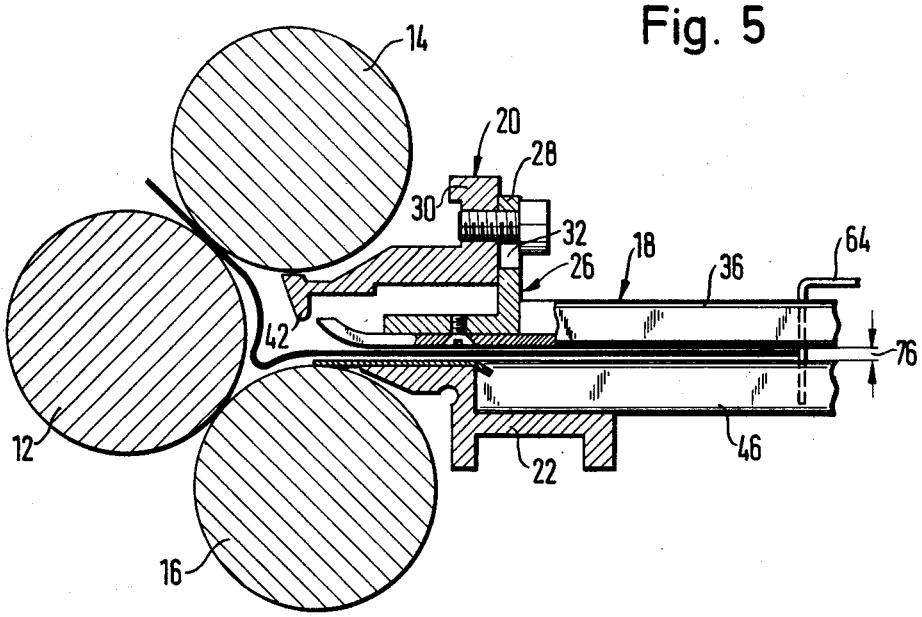
FIG. 5 is a cross-section through the folding rollers and the adjoining portion of the pocket, the pocket being shown at its minimum width.
Figure 6:
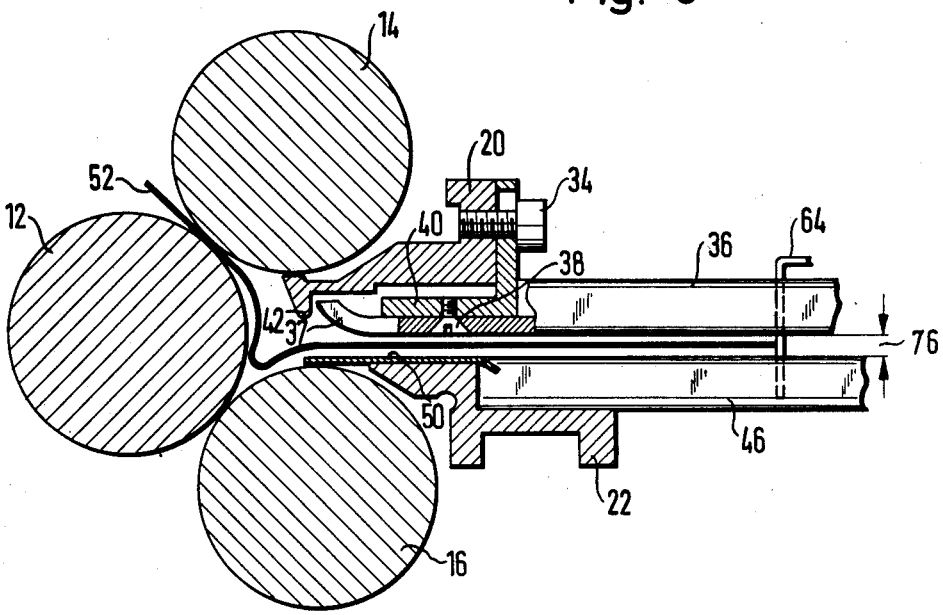
FIG. 6 is a section similar to FIG. 5 yet showing the pocket at its maximum width.

The width of the opening for the entry of sheet 52 is varied by loosening screws 34 and moving L-section rail 26 upwardly or downwardly, respectively, and then retightening the screws 34. Hereby the opening may be adapted to different thicknesses of sheets or multiple layers of sheets between the extreme narrow position shown in FIG. 5 and the extreme wide position shown in FIG. 6. The upper rods 36 are for this adjustment lightly bent inasmuch as their rear ends are ridigly held by angle section rail 44. This adjustment does not mean any change of the position of lip members 20 and 22 relative to the upper roller 14 or the lower roller 16, respectively.

The channel or I cross-section of rods 36 and 46 is such that it provides for line contact only between them and sheet 52 pushed in between them.

So as to adjust the width of the inner portions of the pocket, there are provided screws 54 between the lateral rails 49, secured at the front end to lower lip member 22 and at the rear to the inner lower L-section 48, and bracket members 56. The screws 54 are screwed into bracket plates 56 and their lower ends press against the lateral lower rails 49. Members 56 are integrally secured over brackets 24 to the side plates 10 of the machine frame. The actions of the screws 54 overcome the pressure of springs 58 inserted between the plates or rails 49 and the end of bolts 60 extending through holes in rails 49 and screw threaded into the bracket plates 56. Nuts 62 on bolts 60 adjustably limit the approach of the lower rails 49 toward the bracket plates 56. Here again, the movement of the inner ends of rods 46 and of the lateral rails 49 with their connecting rear angle section 48 means deflection or rods 46 and rails 49 about their forward ends fixedly secured to lower lip member 22.

As customary in paper folding machines, an abutment member or rail 64 is supported on a member 66 movably toward and away from the rollers. The member 66 can be secured on a rod 68 by means of a handscrew 70, and the rod 68 is, for the purpose of fine adjustment of the abutment 64 screw threaded on a stud or pin 72 integrally secured to rail 26 and on its opposite end provided with a turning knob 74.

The operation of the new machine is as follows:

The width 76 (FIG. 5, 6) of the pocket is adjusted by adjustment of L-section rail 26 relative to upper lip member 20 and by adjustment of the inner width of the pocket by means of pressure screws 54 of which there is at least one provided on each side of the pocket. This adjustment is mostly done by trial and error.

Also the depth of the pocket is adjusted by adjustment of abutment 64 which determines the location of the fold in the paper.

Sheets 52 of paper or other material 52 are then fed one after the other into the bite between first roller 12 and upper roller 14, the leading edge of sheet 52 is deflected by upper lip member 20, its ridge 42 and the forward ends of rods 36 onto plate 50 on lower lip member 22 whereupon the leading edge enters into the pocket. Upon the leading edge of sheet 52 hitting the abutment 64, the sheet is forced to escape downwardly and forms a fold which enters the bite between the middle roller 12 and the lower roller 16 causing the withdrawal of the folded sheet 52 out of the pocket. The same cycle then is repeated with the next sheet.

The invention is not restricted to the specific illustrated embodiment and to the details thereof but protection is sought for all modifications and adaptations which will occur to those skilled in the art and which are covered by the language and the spirit of the attached claims.

What is claimed is:

1. A paper folding machine of the buckle folding type, including, a. means for feeding sheet material, b. a sheet receiving pocket for receiving sheet material fed by said feed means, c. the interior of said pocket defined by generally planar and horizontally disposed upper and lower walls, d. a forward entrance to said pocket, said entrance defined by upper and lower parallel lip members horizontally disposed, at least the upper lip member being stationary, e. said pocket bounded rearwardly of the said entrance above and below by said upper and lower walls, said walls each defined by elongated elements spaced from each other, f. the lower elongated elements secured at their forward ends to said lower lip member, g. the upper elongated elements secured adjacent their forward ends to a rail member, the forwardmost ends of said upper elongated elements being curved forwardly and upwardly, h. said rail member being vertically adjustably secured to said upper lip member for adjusting the vertical distance between said upper and lower walls.

2. The machine of claim 1 including an abutment member entending into the pocket and adjustable forwardly and rearwardly of the pocket.

3. The machine of claim 1 wherein said feed means is defined by a pair of rollers contiguous to said pocket entrance.

4. A paper folding machine of the buckle folding type, including, a. at least three elongated rollers rotatably mounted in a machine frame and having cylindrical outer surfaces, b. the axes of rotation of said rollers extending parallel to one another and constituting in a section transversely to them the apexes of a triangle, c. a first one of said roller having its said outer surface arranged in close proximity to both the said outer surfaces of a second one and a third one of said rollers so as to permit a sheet to be gripped between the said surfaces arranged in close proximity, d. said outer surfaces of said second and said third rollers being arranged at a distance from one another to thereby define a space therebetween, e. a generally planar folding pocket for receiving paper fed by the first and second rollers, said pocket extending into the space between said second and third rollers and having an elongated entrance opening extending parallel to and facing said first roller, f. said folding pocket having at its entrance an upper lip member and a lower lip member, said lip member entending parallel to the axes of said rollers and also entending into the space between said second and third roller and being secured to said machine frame, g. upper and lower elongated elements defining upper and lower walls of said pocket and extending from said lip members in a direction away from said rollers and defining a space therebetween, h. said lip members forming between them an elongated and generally rectangular entrance opening for guiding between them a sheet to be fed into said pocket, i. the said upper wall of said pocket having its forward portion adjoining said entrance opening and means adjustably securing said upper wall to said upper lip member for adjusting the space between the upper and lower walls.

5. In a folding machine according to claim 4, said upper lip member having an elongated recess, the forward parts of the upper of said elongated elements being received in said recess.

6. In a folding machine according to claim 5, said elongated recess of said upper lip being formed by a ridge extending downwardly along the front lower margin of said upper lip member.

7. In a folding machine according to claim 4, said upper lip member being rounded-off and the forward ends of said upper elongated elements being rounded-off, the surfaces of the latter being adjacent to and merging towards the rounded-off surface of said first lip member.

8. In a folding machine according to claim 7, means for adjusting the spacing between said first and said second walls including spring elements biased to pull said walls towards each other and threaded elements to space them.

9. In a folding machine according to claim 4, said upper and lower lip members being adjustably connected relative to each other.

10. In a folded machine according to claim 4, said upper wall element including a rail vertically adjustably secured to said upper lip member, the forward ends of said upper elongated elements fixedly connected to and extending transversely of said rail.

11. In a folding machine according to claim 4, said lower lip member being recessed along a marginal part thereof rearwardly of said entrance opening and said second wall element comprising rods spaced from one another and extending normal to said lip members and being secured at their forward ends in the said recess of said lower lip member.

* * * * *